United States Patent [19]

Okuda et al.

[11] Patent Number: 4,875,400

[45] Date of Patent: Oct. 24, 1989

[54] ELECTRONIC MUSICAL INSTRUMENT WITH TOUCH RESPONSE FUNCTION

[75] Inventors: Hiroko Okuda; Makoto Takenaka, both of Tokyo, Japan

[73] Assignee: Casio Computer Co., Ltd., Tokyo, Japan

[21] Appl. No.: 199,116

[22] Filed: May 26, 1988

[30] Foreign Application Priority Data

May 29, 1987 [JP] Japan ..... 62-82620[U]
May 29, 1987 [JP] Japan ..... 62-82622[U]
May 29, 1987 [JP] Japan ..... 62-82624[U]

[51] Int. Cl.[4] ..... G10H 1/053; G10H 1/18

[52] U.S. Cl. ..... 84/626; 84/633; 84/658; 84/665

[58] Field of Search ..... 84/1.1–1.13, 84/1.24, 1.25, 1.27

[56] References Cited

U.S. PATENT DOCUMENTS 4,416,178 11/1983 Ishida ..... 84/1.1 X
4,628,785 12/1986 Buchla ..... 84/1.1
4,706,537 11/1987 Oguri ..... 84/1.1 X

*Primary Examiner*—Stanley J. Witkowski
*Attorney, Agent, or Firm*—Frishauf, Holtz, Goodman & Woodward

[57] ABSTRACT

In preparing a musical tone by synthesizing tone waveforms from a plurality of tone waveform generators, touch response data representing parameters such as key depressing speed or string picking force is generated from a touch response data preparing unit. The obtained touch response data can be used to affect the musical tone. Touch curves can be independently designated to these tone waveform generators with a manually operating unit. A weighting device for modifying a touch curve by selecting loudness level and sensitivity is provided so that various touch curves can be attained from a single touch curve for weighting the musical tone.

9 Claims, 9 Drawing Sheets

| MODE NO. | CONTENTS | DATA RANGE |
|---|---|---|
| 0 0 | WAVEFORM TYPE I | 0 ~ 31 |
| 0 1 | WAVEFORM TYPE II | 0 ~ 31 |
| 0 2 | VIBRATO WAVEFORM | 0 ~ 4 |
| 0 3 | VIBRATO MODULATION | 0 ~ 31 |
| 0 4 | ATTACK TIME OF VCF | 0 ~ 31 |
| 0 5 | DECAY TIME OF VCF | 0 ~ 31 |
| 0 6 | SUSTAIN LEVEL OF VCF | 0 ~ 31 |
| 0 7 | RELEASE TIME OF VCF | 0 ~ 31 |
| 0 8 | SENSITIVITY OF VCF | 0 ~ 31 |
| ⋮ | ⋮ | ⋮ |
| ⋮ | ⋮ | ⋮ |
| 2 0 | ATTACK TIME OF DCA | 0 ~ 31 |
| 2 1 | DECAY TIME OF DCA | 0 ~ 31 |
| 2 2 | SUSTAIN LEVEL OF DCA | 0 ~ 31 |
| 2 3 | RELEASE TIME OF DCA | 0 ~ 31 |
| | ⋮ | ⋮ |

FIG. 3

TOUCH RESPONSE DATA

W
7
MD (5)
2
W

W1
6
MD
3.5

MD

SENSITIVITY CORRECTION (AVERAGING)
LEVEL CORRECTION (PARALLEL SHIFT)

ELECTRONIC MUSICAL INSTRUMENT WITH TOUCH RESPONSE FUNCTION

BACKGROUND OF THE INVENTION

1. Field of the Invention

The present invention relates to an electronic musical instrument with a touch response function, which reflects the touch response such as key-depressing speed or string picking force of operating means such as keys or strings, onto musical tones.

2. Description of the Related Art

Conventionally, there are electronic musical instruments which produce musical tone waveforms from a plurality of tone waveform generators, synthesize these waveforms and generate a musical tone having the synthesized waveform, thus providing musical tones with depth for ensemble effects. CZ-1, a Casio product, is an example of such instruments. This type of electronic musical instruments have some problems. The first problem is that there is not sufficient variation in a musical tone due to the use of only one type of a touch response waveform data (herein after referred to as touch curve) in all the tone generators in modulating individual tone waveforms from the mentioned tone waveform generators based on touch curves having parameters such as a key depressing speed in order to reflect the key depressing speed etc. on musical tones These touch curves increase with an increase in, for example, key depressing speed.

The second problem is that the aforementioned product, CZ-1, corrects or changes the values of a touch curve to attain a new touch curve by simply performing addition, subtraction, multiplication and division of the same correction value on all the values of the old touch curve. That is, the pattern of the touch curve itself does not vary. Naturally, this cannot provide a large variation in musical tones.

SUMMARY OF THE INVENTION

It is an object of this invention to provide an electronic musical instrument with a touch response function, which, in preparing a musical tone by synthesizing tone waveforms from a plurality of tone waveform generators, ensures designation of touch curves with respect to the individual tone waveform generators and reflects a touch state or mode on musical tones based on plural types of touch curves, thus providing various musical tones.

It is another object of this invention to provide an electronic musical instrument with a touch response function, which has means for correcting touch curves so that in addition to the above feature, various touch curves can be attained from a single touch curve.

It is a further object of this invention to provide an electronic musical instrument with a touch response function, which can attain a number of touch curves of different shapes by acquiring interpolation values between the values of a prestored touch curve from memory means and reference values based on input correction information.

According to one aspect of this invention, there is provided an electronic musical instrument with a touch response function for synthesizing a plurality of tone waveform data from a plurality of tone waveform generating means for generation of a musical tone, which instrument comprises:

operating means;

touch data preparing means for detecting a touch state of the operating means and generating touch data;

memory means for storing a plurality of touch response waveform data having, as a parameter, the touch data to be prepared by the touch data preparing means;

designation means for designating one of the plurality of touch response waveform data for each of the plurality of tone waveform generating means; and modulation means for modulating the tone waveform data from each of the plurality of tone waveform generating means using that touch response waveform data designated by the designation means which corresponds to the touch data to be prepared by the touch data preparing means

BRIEF DESCRIPTION OF THE DRAWINGS

FIGS. 3 and 4 are diagrams for explaining the operation of the operation panel shown in FIG. 2;

DETAILED DESCRIPTION OF THE PREFERRED EMBODIMENT

Embodiments of this invention will be explained below referring to the accompanying drawings.

First Embodiment

<Overall Structure>

Figure 1:
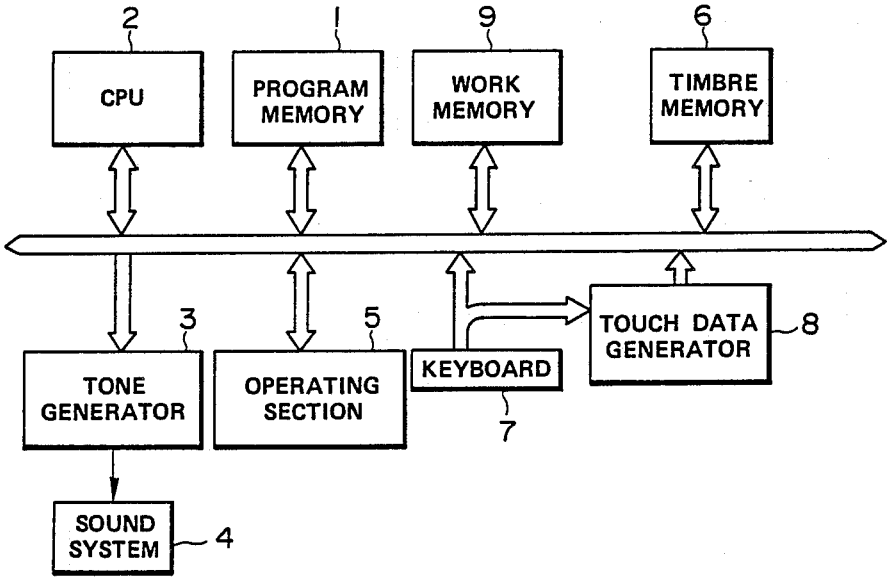
FIG. 1 is a diagram illustrating the overall structure of an electronic musical instrument with a touch response function according to an embodiment of this invention.

FIG. 1 illustrates the overall structure of an electronic musical instrument with a touch response function according to an embodiment of this invention as applied to a keyboard type synthesizer.

The present synthesizer prepares a tone waveform in a tone generator 3 and converts the waveform into an acoustic signal in a sound system 4 to tone generation under the control of a CPU 2 in accordance with programs prestored in program memory 1. The preparation of the tone waveform is performed by utilizing various musical tone parameters, which are edited and entered through an operating section 5 and stored in a timbre memory 6. Operating section 5 is provided on an operation panel 50 shown in FIG. 2 and comprises a mode switch SW1 and a parameter switch SW2, both of a rotary-switching type. For instance, if mode number "00" is input through mode switch SW1 and a parameter (data) "00" is input through parameter switch SW2, a sawtooth waveform is selected as the waveform of the output of a digital controlled oscillator DCO of tone generator. At this time, the operational contents of mode switch SW1 and parameter switch SW2 are displayed on a first display section DP1 shown in FIG. 2. A group of data for tone preparation, which includes mode data from mode switch SW1 and parameters from parameter switch SW2, is temporarily stored in a predetermined register of a work memory 9, and it is then added with a timbre name with the operation of a predetermined key of operating section 5 and is stored in a timbre memory 6. FIG. 3 illustrates examples of the data. As shown in FIG. 3, generally, parameters (mode No. 04–07) for timbre envelopes and parameters (mode No. 20–23) for loudness envelopes are stored in timbre memory 6.

Tone generator 3 has four digital controlled 5 oscillators DCO1–DCO4, which are designed to be able to simultaneously output tone waveform data of the same spectrum, such as sawtooth waveforms. Tone generator 3 is further designed such that different loudness touch curves are assigned to the respective digital controlled oscillators DCO1–DCO4 to designate the sensitivities or levels of the oscillators. This designation will be described below more specifically.

Figure 4:
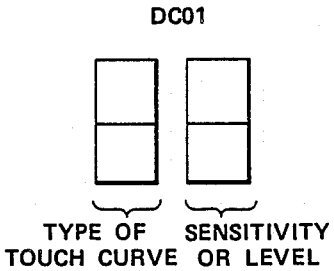
Figure 2:
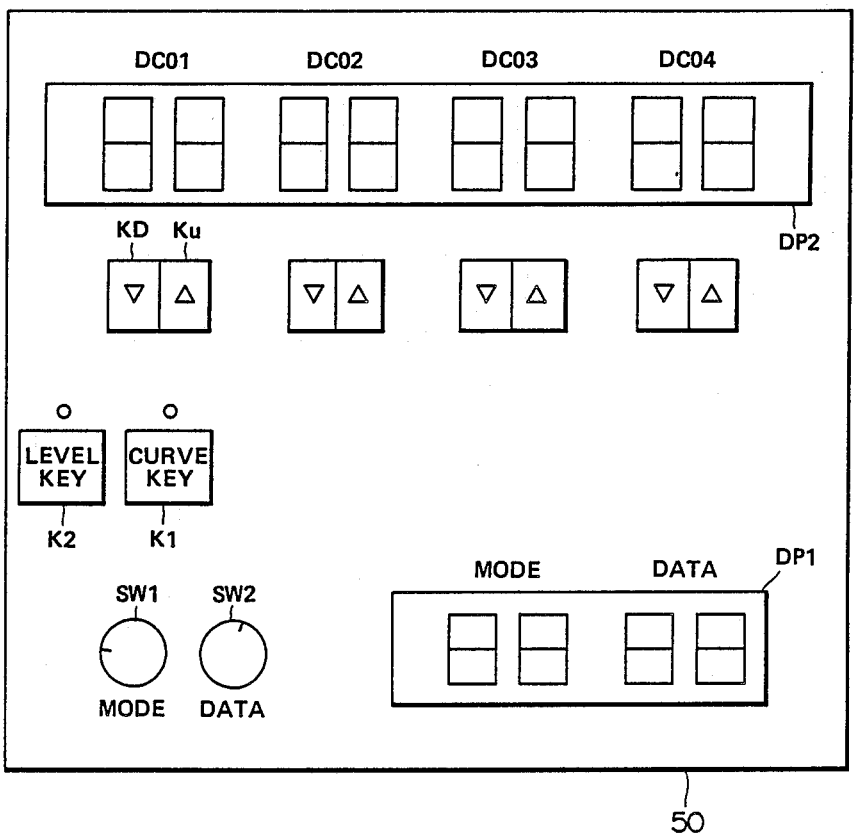
FIG. 2 is a diagram illustrating part of an operating section shown in FIG. 1.

Operating section 5 has a curve key K1, a level key K2, four pairs of up keys KU and down keys KD, and a second display section DP2, as shown in FIG. 2. The second display section DP2 has four pairs of 8-shaped liquid crystal elements, each pair constituting two digits which is each capable of displaying any of numerals 0–9. As shown in FIG. 4, the display content of the left hand side digit of each display element pair represents the type of a loudness touch curve while the display content of the right hand side digit represents the sensitivity or level for the loudness touch curve indicated by the left digit. These display contents or the loudness touch curves for the respective digital controlled oscillators DCO1–DCO4 and their sensitivities or levels are changed by operating curve key K1 for variation in sensitivity or level key K2 for variation in level and operating up keys KU and down keys KD for setting values as selected from 00–99.

A keyboard 7 is used to designate a tone generation and providing pitch data for determining the frequency of a tone waveform from tone generator 3 to specify the pitch. The speed of depressing keys on keyboard 7 is detected by a touch data generator 8 and is output as touch data to tone generator 3. This key depressing speed is reflected on the loudness and timbre in tone generator 3.

<Arrangement of Tone Generator 3>

Figure 5:
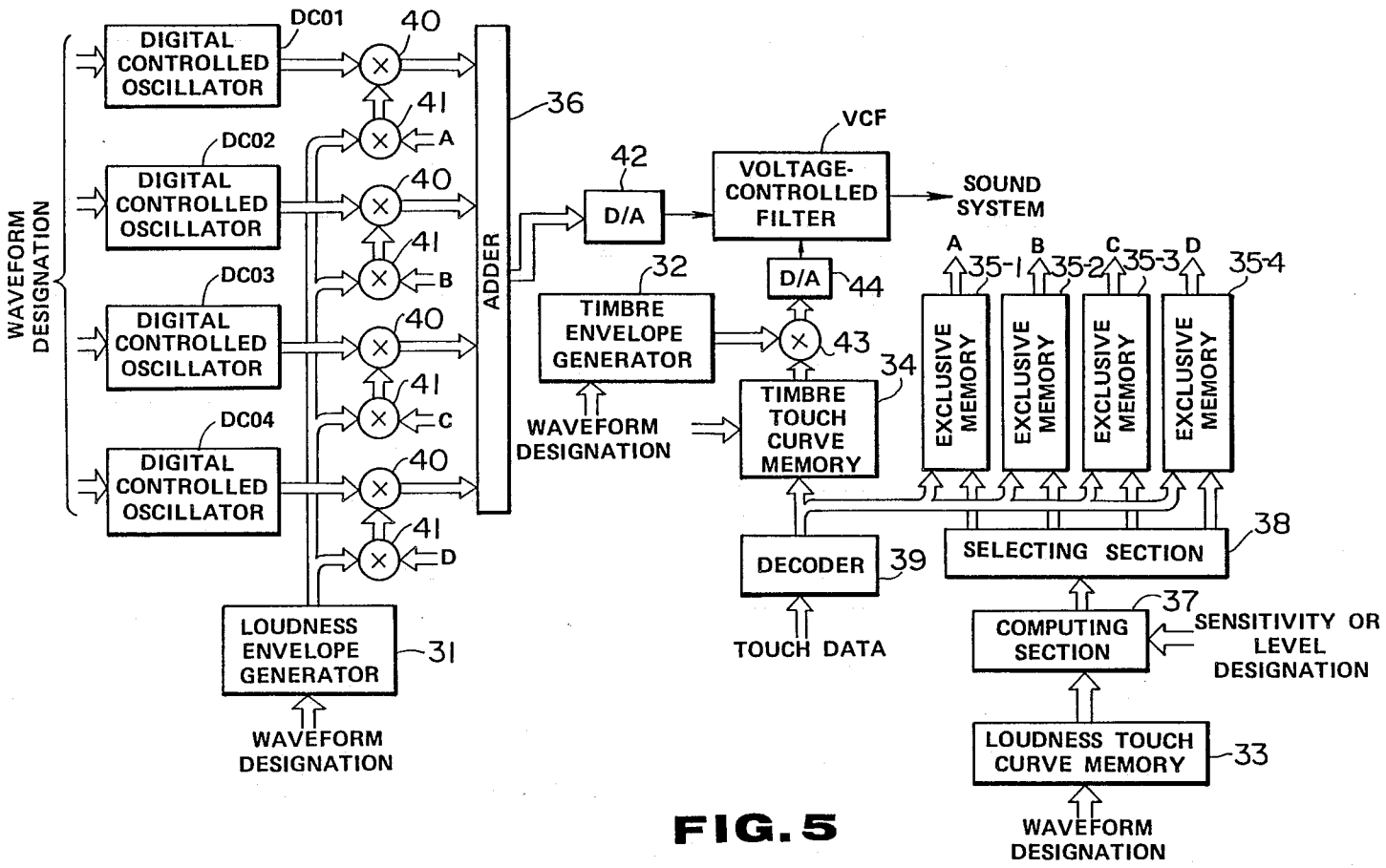
FIG. 5 is a diagram illustrating the arrangement of a tone generator shown in FIG. 1.
Figure 6A:
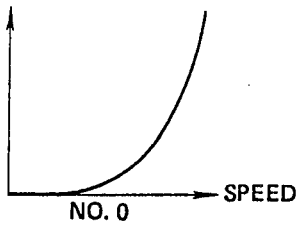
FIGS. 6A to 6J show diagrams illustrating types of touch curves stored in a loudness touch curve memory.
Figure 6B:
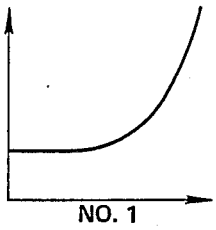
Figure 6C:
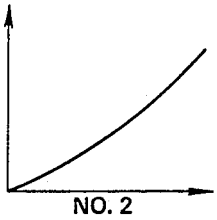
Figure 6D:
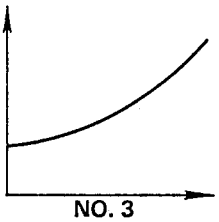
Figure 6E:
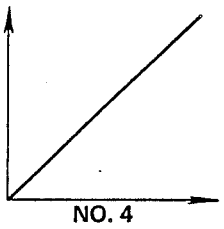
Figure 6F:
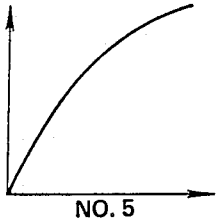
Figure 6G:
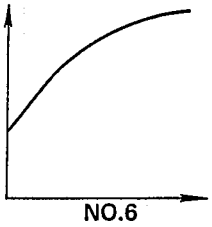
Figure 6H:
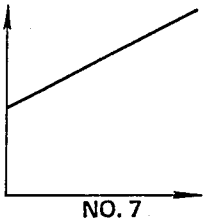
Figure 6I:
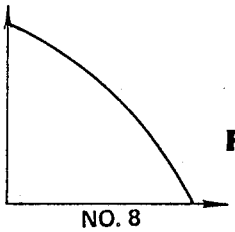
Figure 6J:
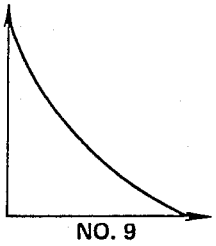

FIG. 5 illustrates the arrangement of tone generator 3, which comprises, in addition to the aforementioned digital controlled oscillators DCO1–DCO4, a loudness envelope generator 31 for generating a loudness envelope, a timbre envelope generator 32 for generating a timbre envelope, a loudness touch curve memory 33 and a timbre touch curve memory 34. A plurality of loudness touch curves for reflecting the key depressing speed on a loudness are stored in loudness touch curve memory 33. A plurality of timbre curves for reflecting the key depressing speed on a timbre are stored in timbre touch curve memory 34.

Tone generator 3 further comprises four exclusive memories 35-1 to 35-4 for storing loudness touch curves in one-to-one association with digital controlled oscillators DCO1–DCO4. The loudness envelope prepared by loudness envelope generator 31 is corrected, or modified on the basis of different loudness touch curves stored in exclusive memories 35-1 - 35-4 to thereby provide four loudness envelopes which have the key depressing speed reflected thereon. These four loudness envelopes are used to control the amplitude of the tone waveform data from the individual digital controlled oscillators DCO1–DCO4 or the loudness The four pieces of tone waveform data, which have been subjected to loudness control based on the key depressing speed, are added in an adder 36 and the resultant data is subjected to timbre control in a voltage controlled filter VCF. This timbre control is performed using timbre envelopes, which are attained by correcting or changing the timbre envelope from timbre envelope generator 32 based on the timbre touch curve from timbre touch curve memory 34 and which have the key depressing speed reflected thereon. The sensitivities or levels of the loudness touch curves which are to be stored in the respective exclusive memories 35-1 to 35-4 are independently set by a computing section 37. p0 <Operation of Tone Generator 3>

The following explains the operation of tone generator 3.

Assume that "35" is designated as that value in second display section DP2 which corresponds to digital controlled oscillator DCO1, by operating curve key K1 with subsequent operation of the associated up key KU and down key KD. Then, a loudness touch curve corresponding to the waveform information number "3" is read out from loudness touch curve memory 33 and is supplied to computing section 37. FIG. 6A to 6J illustrate the types of touch curves respectively.

Based on the designated sensitivity "5," computing section 37 corrects the loudness touch curve read out from loudness touch curve memory 33 and supplies it to a selecting section 38. This selecting section 38 recognizes with which digital controlled oscillator DCO the operated up key KU and down key KD are associated and permits the corrected loudness touch curve to exclusive memory 35 for the associated oscillator DCO. In the above example, as the operated up key KU and down key KD are associated with digital controlled oscillator DCO1, the corrected loudness touch curve is stored in exclusive memory 35-1.

Sequential operation of up key KU and down key KD for each digital controlled oscillator DCO causes the loudness touch curve subjected to sensitivity control to be stored in the associated exclusive memory 35. The display content of first display section DP1 will not be erased even when the operation of up key KU and down key KD for another digital controlled oscillator DCO is performed. When the modification operation for all the digital controlled oscillators DCO is completed, the designation contents for all the oscillators DCO are simultaneously displayed on first display section DP1. The order of the waveform designation and sensitivity designation for the individual digital controlled oscillators DCO is not fixed.

Assume now that "25" is designated as that value in second display section DP2 which corresponds to digital controlled oscillator DCO1, by operating curve key K1 with subsequent operation of the associated up key KU and down key KD. Then, a loudness touch curve corresponding to the waveform information number "2" is read out from loudness touch curve memory 33 and is supplied to computing section 37.

Figure 9A:
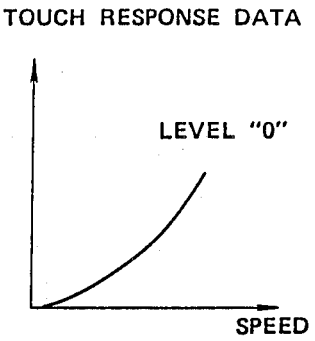
FIGS. 9A to 9C show diagrams illustrating a variation in a touch curve with a change in level.
Figure 8B:
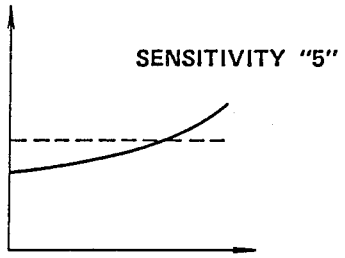
Figure 9B:
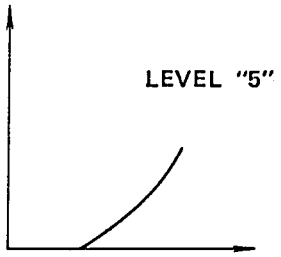
Figure 8C:
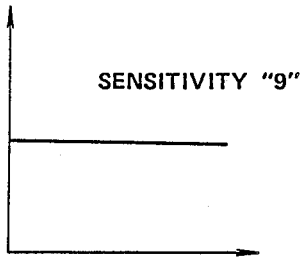
Figure 9C:
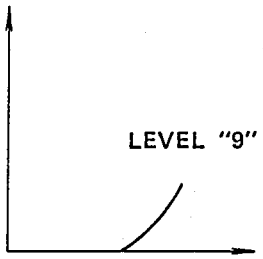

Based on the designated level "5," computing section 37 corrects the loudness touch curve read out from loudness touch curve memory 33 and supplies it to selecting section 38. The subsequent operation is the same as the one for the case where curve key K1 is operated. Here, with level "0," the original touch curve is retained and with a gradual increase in level, the peak values of the touch curve gradually decrease as shown in FIGS. 9A to 9C. That is, the touch curve is shifted down in parallel.

The operation of computing section 37 will now be explained. This computing section 37 computes an input peak value W based on sensitivity data f or level data g and performs sensitivity correction (averaging) and level correction (parallel shifting) of the loudness touch curve stored in loudness touch curve memory 33 for each digital controlled oscillator DCO.

Figures 7A, 7B, 7C, 7D, 7E:
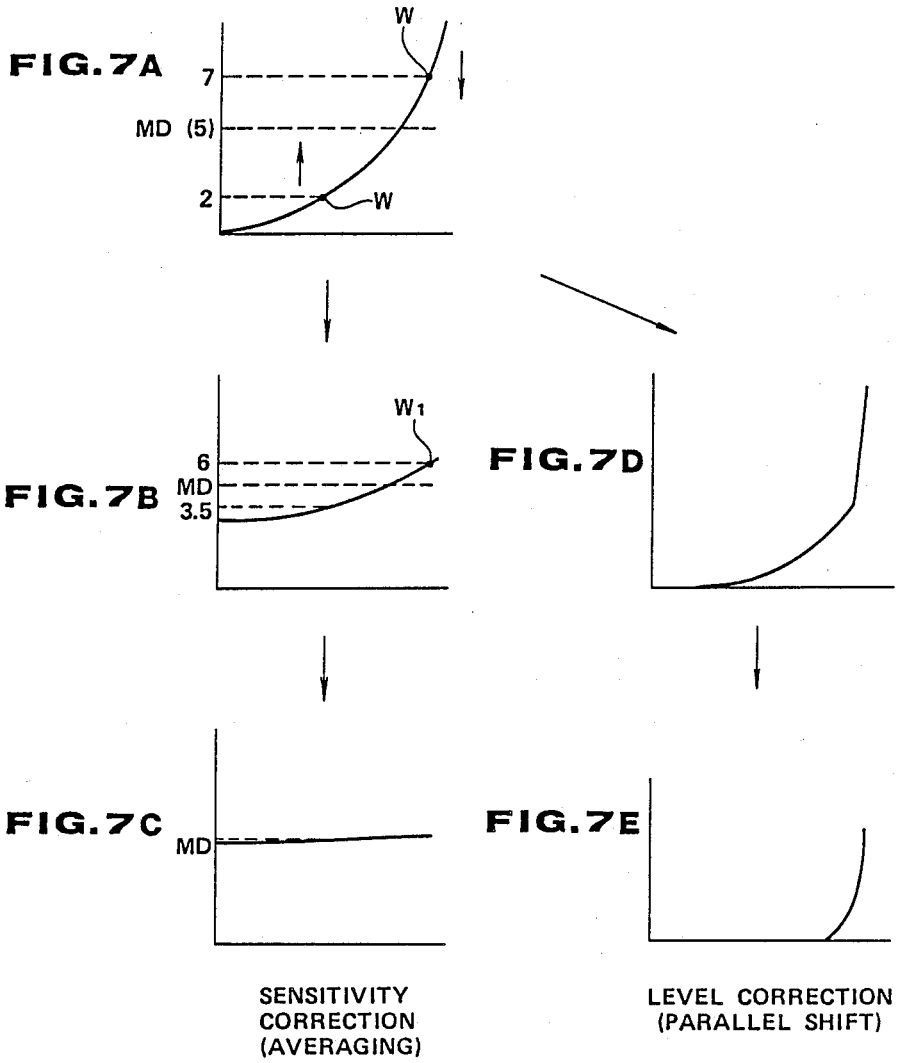
FIGS. 7A to 7E show diagrams for conceptually explaining the operational contents of a computing section.
Figure 8A:
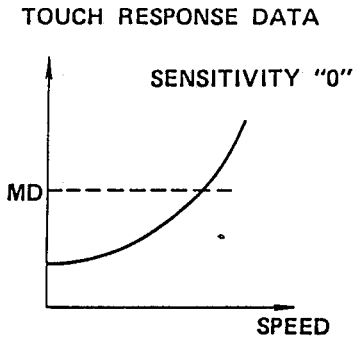
FIGS. 8A to 8C show diagrams illustrating a variation in a touch curve with a change in sensitivity.

According to the sensitivity correction process, the loudness touch curve (as shown in FIG. 7(A) stored in loudness touch curve memory 33 is averaged or its changing factor is reduced to change the shape of the curve by reducing the peak values for that portion of the loudness touch curve which is above the middle value MD and increasing the peak values for that portion which is below the value MD, as shown in FIGS. 7(B) and 7(C). According to the level correction process, the loudness touch curve is parallel-shifted by subtracting a predetermined value from all the peak values of that touch curve, as shown in FIGS. 7D and 7E.

Figure 10:
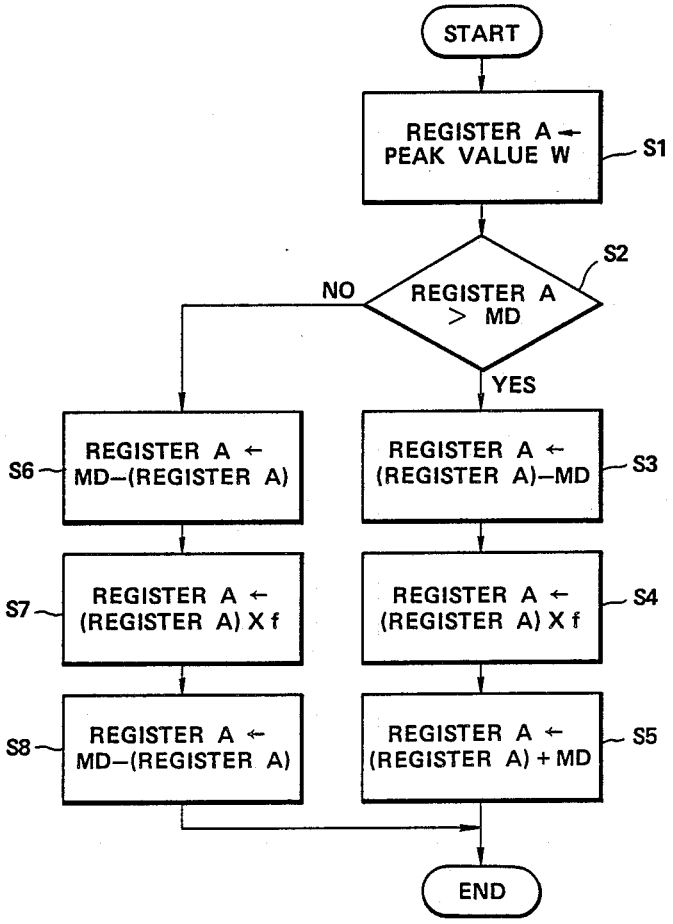
FIG. 10 is a flowchart for explaining the operation of a sensitivity process.

The practical operation of the sensitivity correction process will be explained first, referring to FIG. 10.

When supplied with the peak value W from loudness touch curve memory 33, computing section 37 stores the peak value W in a register A (step S1). In the next step S2, computing section 37 discriminates whether or not the peak value W in register A is greater than the middle value MD. If W>MD, the middle value MD is subtracted from the peak value W in register A (step S3), the resultant value is multiplied by averaging factor data f (step S4) and the resultant value is added with middle value MD (step S5).

If the peak value W is found to be equal to or greater less than the middle value MD in step S2, the peak value W is subtracted from the middle value MD (step S6), the resultant value is multiplied by the averaging factor data f (step S7) and the resultant value is subtracted from the middle value MD (step S8). The above operation is performed for every waveform data.

For instance, given that MD=5 and f=0.5, when W=7, the corrected peak value $W_1$ is "6," and when W=2, the corrected peak value $W_1$ is "3.5." That is, the loudness touch curve is averaged and changed from the one shown in FIG. 7(A) to the one shown in FIG. 7(B). When the averaging factor data f is "1," the touch curve will not be changed and when f is "0," the curve becomes straight as shown in FIG. 7(C).

The parallel shifting is conducted simply by subtracting the level data g from peak values W so that its detailed explanation will be omitted, as shown in FIGS. 7D and 7E. When the level data g is "0," the curve will not be changed.

In the above manner, a number of loudness touch curves with new shapes are attained from a single loudness touch curve.

When a timbre name is designated after the operation for designating a loudness touch curve for each digital controlled oscillator DC and the sensitivity correction or level correction of that curve are executed, and keyboard 7 is operated, waveform designation parameters indicating the same spectrum waveform and the same pitch data are supplied to the individual digital controlled oscillators DCO under the control of CPU 2. In response to the input data, the individual digital controlled oscillators DCO output tone waveform data with the same spectrum and the same frequency to associated first multipliers 40. Meanwhile, loudness envelope generator 31 is supplied with parameters of loudness envelopes corresponding to mode no. 20–23 shown in FIG. 3. Based on the parameters, loudness envelope generator 31 prepares loudness envelopes and supplies them to second multipliers associated with the individual digital controlled oscillators DCO.

When keyboard 7 is operated, the key depressing speed is detected by touch data generator 8 and the touch data representing the speed is supplied to a decoder 39. Decoder 39 in turn decodes the input touch data into address data and supplies it to timbre touch curve memory 34 and exclusive memories 35. Consequently, the peak value of the loudness touch curve corresponding to the input address data is read out from each exclusive memory 35 and is outputted to second multiplier 41 of the associated digital controlled oscillator DCO. Each second multiplier 41 multiplies the loudness envelope from loudness envelope generator 31 by the peak value from the associated exclusive memory 35 to reflect the key depressing speed on the envelope and outputs the modified loudness envelope to the associated first multiplier 40. Each first multiplier 40 multiplies the received loudness envelope by the tone waveform data from the associated digital controlled oscillator DCO to control the amplitude of the tone waveform data from the associated oscillator DCO or the loudness in consideration of the key depressing speed, and then outputs the resultant data to adder 36. In this case, the peak values read out from the associated exclusive memories 35 in accordance with the key depressing speed are based on a specific loudness touch curve designated for the associated digital controlled oscillators DCO and are each subjected to sensitivity setting or level setting. Due to the variety of the peak values, there are a variety of loudnesses of a musical tone corresponding to the individual digital controlled oscillators DCO. The tone waveform data from the individual first multipliers 40 are added in adder 36 and the resultant data is converted into an analog signal by a first D/A converter 42. The analog signal is then supplied to voltage controlled filter VCF When a timbre name is designated, timbre envelope generator 32 is supplied with parameters for timbre envelopes corresponding to mode no. 01–07 shown in FIG. 3, under the control of CPU 2, and timbre touch curve memory 34 is supplied with a parameter for the sensitivity corresponding to mode no. 08. Timbre envelope generator 32 prepares a timbre envelope based on the received parameters and outputs it to a third amplifier 43. A timbre touch curve corresponding to the received parameter for sensitivity is selected, and the peak value in the selected timbre touch curve corresponding to the address data is read out from timbre touch curve memory 34 and is output to third multiplier 43. Third multiplier 43 multiplies the timbre envelope from timbre envelope generator 32 by the peak value read out from timbre touch curve memory 34 to reflect the key depressing speed on the timbre envelope and then outputs the modified timbre envelope to a second D/A converter 44. The timbre envelope is converted into an analog signal by second D/A converter 44 and the analog signal is supplied to voltage controlled filter VCF. Based on the timbre envelope from second D/A converter 44, voltage controlled filter VCF controls the spectrum of the tone waveform data from adder 36, i.e., the timbre and outputs the controlled data to sound system 4. In this manner, one of a plurality of timbre touch curves stored in timbre touch curve memory 34 is selected and the touch state or mode is reflected on the timbre based on the selected timbre touch curve. Even with the same touch mode, therefore, the timbre can be varied in various patterns by selecting different timbre touch curves.

According to the first embodiment, memory means is provided to store touch curves assigned to the individual tone waveform generating means and a correcting means is provided o correct the touch curves stored in the memory means, whereby a number of touch curves can be prepared from data stored in a fewer number of memory means. This can reduce the necessary capacity of the memory means.

SECOND EMBODIMENT

Figure 11:
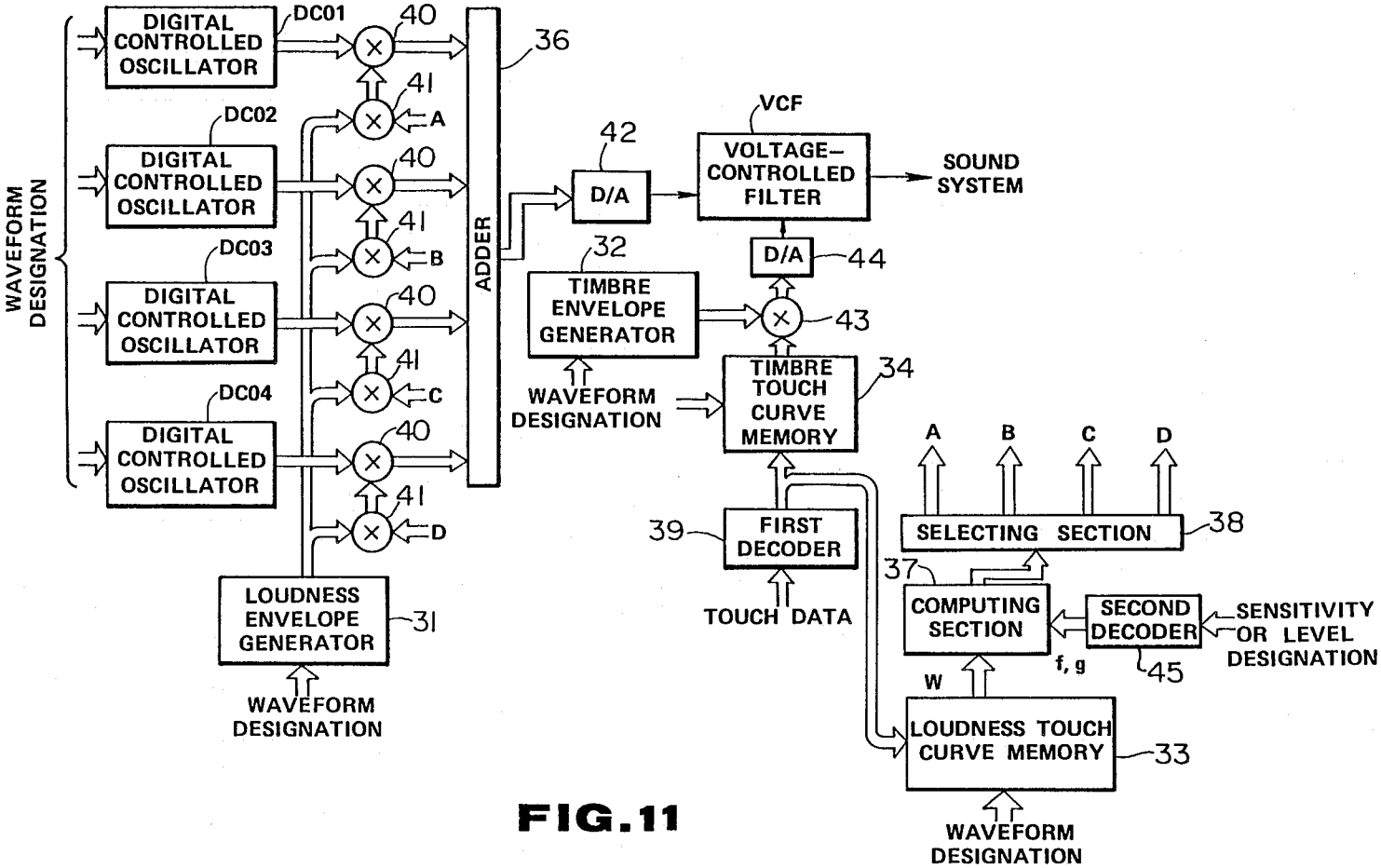
FIG. 11 is a diagram illustrating another arrangement of the tone generator shown in FIG. 1.

FIG. 11 illustrates another arrangement of tone generator 3, which comprises, in addition to the aforementioned digital controlled oscillators DCO1–DCO4, loudness envelope generator 31 for generating a loudness envelope, timbre envelope generator 32 for generating a timbre envelope, loudness touch curve memory 33 and timbre touch curve memory 34. A plurality of loudness touch curves for reflecting the key depressing speed on a loudness are stored in loudness touch curve memory 33. A plurality of timbre touch curves for reflecting the key depressing speed on a timbre are stored in timbre touch curve memory 34.

Tone generator 3 further comprises computing section 37 for correcting or changing the loudness touch curves stored in loudness touch curve memory 33 based on the sensitivity and level designated by the operation of curve key K1 and level key K2. The loudness envelope prepared by loudness envelope generator 31 is corrected or changed by computing section 37 on the basis of four loudness touch curves, which have been corrected for the individual digital control oscillators DCO to thereby provide four loudness envelopes which have the key depressing speed reflected thereon. These four loudness envelopes are used to control the amplitude of the tone waveform data from the individual digital controlled oscillators DCO or the loudness. The four pieces of tone waveform data, which have been subjected to loudness control based on the key depressing speed, are added in adder 36 and the resultant data is subjected to timbre control in a voltage controlled filter VCF. This timbre control is performed using timbre envelopes, which are attained by correcting or changing the timbre envelope from timbre envelope generator 32 based on the timbre touch curve from timbre touch curve memory 34 and which have the key depressing speed reflected thereon.

<Operation of Tone Generator 3>

The following explains the operation of tone generator 3.

Assume that "26" is designated as that value in second display section DP2 which corresponds to digital controlled oscillator DCO1, by operating curve key K1 with subsequent operation of the associated up key KU and down key KD. Then, a loudness touch curve corresponding to the waveform information number "2" is read out from loudness touch curve memory 33 and the peak value W addressed by the touch data put through a first decoder 39, which will be described later, is supplied to computing section 37.

The designated sensitivity "6" is supplied to a second decoder 45 whose output (decoded value) is as sensitivity data f (0–1.0) to computing supplied section 37.

Upon sequential operation of up key KU and down key KD for each digital controlled oscillator DCO, the peak value W and sensitivity data f for the associated digital controlled oscillators is supplied computing section 37.

Assume now that "34" is designated as that value in second display section DP2 which corresponds to digital controlled oscillator DCO1, by operating curve key K1 with subsequent operation of the associated up key KU and down key KD. Then, a loudness touch curve corresponding to the waveform information number "3" is read out from loudness touch curve memory 33 and is supplied to computing section 37.

The designated level "4 is supplied to second decoder 45 whose output (decoded value) is supplied to computing section 37 as level data g (0–M: maximum values of peak values W).

Upon sequential operation of up key KU and down key KD for each digital controlled oscillator DCO, the peak value W and level data g for the associated digital controlled oscillators is supplied computing section 37.

The display content of first display section DP1 will not be erased even when the operation of up key KU and down key KD for another digital controlled oscillator DCO is performed. When the correction operation for all the digital controlled oscillators DCO is completed, the designation contents for all the oscillators DCO are simultaneously displayed on first display section DP1. The order of the individual designation processes for the individual digital controlled oscillators DCO may be varied.

When a timbre name is designated after the waveform designation the sensitivity designation for a loudness touch curve for each digital controlled oscillator DCO are executed, and keyboard 7 is operated, reference waveform designation parameters indicating the same spectrum waveform and the same pitch data are supplied to the individual digital controlled oscillators DCO under the control of CPU 2. In response to the input data, the individual digital controlled oscillators DCO output tone waveform data with the same spectrum and the same frequency to the associated first multipliers 40. Meanwhile, loudness envelope generator 31 is supplied with parameters of loudness envelopes corresponding to mode no. 20–23 shown in FIG. 3. Based on the parameters, loudness envelope generator 31 prepares loudness envelopes and supplies them to second multipliers associated with the individual digital controlled oscillators DCO.

When keyboard 7 is operated, the key depressing speed is detected by touch data generator 8 and the touch data representing the speed is supplied to first decoder 39. First decoder 39 in turn decodes the input touch data into address data and supplies it to timbre touch curve memory 34 and loudness touch curve memory 33. Consequently, the peak value W of the loudness touch curve corresponding to the input address data and waveform data is read out from loudness touch curve memory 33 and is outputted to computing section 37. The operation of this computing section 37 is the same as the one used in the first embodiment.

When a new peak value subjected to the averaging process and parallel shifting process is prepared for each digital controlled oscillator DCO in the abovedescribed manner, selecting section 38 supplies the peak value to second multiplier 41 of the associated digital controlled oscillator DCO. The subsequent operation is the same as the one performed in the first embodiment.

This invention is in no way limitative to the above-explained embodiments, and may be applied to an electronic stringed instrument which uses strings as tone generation start designating means. For detection of the touch state or mode, the key depressing force, string picking force or the like as well as the mentioned key depressing speed may be detected. In addition, the same correction processes as executed for loudness touch data may be executed for timbre touch data.

What is claimed is:

1. An electronic musical instrument with a touch response function for synthesizing a plurality of tone waveform data from a plurality of tone waveform generating means for generation of musical tone, said instrument comprising;

manually operating means for generating a touch state when it is operated manually;

touch data preparing means for detecting the touch state of said manually operating means to generate touch data;

touch response data preparing means for preparing a plurality of touch response data based on said touch data;

designation means for enabling a player of the electronic musical instrument to designate one of said plurality of touch response data for each of said plurality of tone waveform generating means; and weighting means for weighting said tone waveform data obtained from each of said plurality of tone waveform generating means in response to the respective designated one of said plurality of touch response data.

2. The electronic musical instrument according to claim 1, wherein said touch response data preparing means includes a plurality of memory means in each of which touch response waveform data having touch response data as a parameter is stored.

3. The electronic musical instrument according to claim 2, further comprising setting means for storing arbitrary touch response waveform data in each of said memory means.

4. The electronic musical instrument according to claim 2, wherein said designation means enables designation of any of said plurality of touch response data stored in said memory means for each of said plurality of tone waveform generating means, and wherein said weighting means weights said tone waveform data from each of said plurality of tone waveform generating means using the designated one of said plurality of touch response data.

5. The electronic musical instrument according to claim 1, wherein each of said plurality of tone waveform generating means includes:

a digital controlled oscillator means for outputting a reference waveform;

loudness envelope preparing means for preparing a loudness envelope; and a first multiplier means for multiplying an output from said digital controlled oscillator means by an output of said loudness envelope preparing means.

6. The electronic musical instrument according to claim 5, wherein said weighting means includes a second multiplier means for multiplying said loudness envelope from each of said loudness envelope preparing means by that touch response data which corresponds to said touch data.

7. An electronic musical instrument with a touch response function for synthesizing a plurality of tone waveform data from a plurality of tone waveform generating means for generation of a musical tone, said instrument comprising;

manually operating means for generating a touch state when it is operated manually;

touch data preparing means for detecting the touch state of said manually operating means to generate touch data;

memory means for storing a plurality of touch response waveform data having, as a parameter, said touch data prepared by said touch data preparing means;

designation means for designating one of said plurality of touch response waveform data for each of said plurality of tone waveform generating means;

modifying means for modifying said touch response waveform data designed by said designation means; and weighting means for weighting said tone waveform data from each of said plurality of tone waveform generating means using said touch response waveform data modified by said modifying means.

8. The electronic musical instrument according to claim 7, wherein said modifying means includes:

input means for inputting modification data for modifying shapes of said plurality of touch response waveform data stored in said memory means; and computing means for computing an interpolation value between data read out from said memory means by said touch data and a predetermined reference value based on said modification data.

9. An electronic musical instrument with a touch response function for reflecting a touch state for tone generation start designating means on tone waveform data from tone waveform generating means using touch response waveform data, said instrument comprising;

manually operating means for generating a touch state when it is operated manually;

touch data preparing means for detecting the touch state of said manually operating means and preparing corresponding touch data;

memory means for storing touch response waveform data;

readout means for reading out said touch response waveform data from said memory means by said touch data;

input means for inputting modifying data for modifying a shape of said touch response waveform data stored in said memory means;

computing means for computing an interpolation value between data read out from said memory means by said touch data and a predetermined reference value based on said modifying data; and weighting means for weighting said tone waveform data from said tone waveform generating means based on data attained by said computing means.

* * * * *